US006003728A

United States Patent [19]

Elliott

[11] Patent Number: 6,003,728

[45] Date of Patent: Dec. 21, 1999

[54] DISPENSING STRUCTURE WITH AN OPENABLE MEMBER FOR SEPARATING TWO PRODUCTS

[75] Inventor: John Elliott, Burlington, Wis.

[73] Assignee: AptarGroup, Inc., Crystal Lake, Ill.

[21] Appl. No.: 09/176,860

[22] Filed: Oct. 22, 1998

[51] Int. Cl.[6] ..... B67D 5/00; B67D 3/00; A61J 9/00; B65D 25/08

[52] U.S. Cl. ..... 222/81; 222/83; 222/129; 222/511; 215/11.6; 215/DIG. 8; 206/219; 206/221

[58] Field of Search ..... 222/81, 129, 83, 222/510, 511; 215/DIG. 8, 11.1, 11.6; 206/219, 220, 221, 222

[56] References Cited

U.S. PATENT DOCUMENTS

| | | | |
|---|---|---|---|
| Re. 29,850 | 11/1978 | Labarre . | |
| 2,895,654 | 7/1959 | Rieke . | |
| 3,135,441 | 6/1964 | Wise et al. . | |
| 3,207,375 | 9/1965 | Bereziat et al. . | |
| 3,220,588 | 11/1965 | Lipari | 215/11 |
| 3,239,112 | 3/1966 | Porcelli . | |
| 3,269,617 | 8/1966 | Goth . | |
| 3,278,089 | 10/1966 | Heekin et al. . | |
| 3,282,477 | 11/1966 | Henchert . | |
| 3,292,828 | 12/1966 | Stuart . | |
| 3,310,206 | 3/1967 | Littlefield . | |
| 3,406,872 | 10/1968 | Fiquet et al. . | |
| 3,434,620 | 3/1969 | Laurizio . | |
| 3,458,080 | 7/1969 | Laurizio . | |
| 3,459,315 | 8/1969 | Labarre . | |
| 3,495,746 | 2/1970 | Laurizio . | |
| 3,567,061 | 3/1971 | Song . | |
| 3,580,423 | 5/1971 | Gilman . | |
| 3,610,484 | 10/1971 | Matzka . | |
| 3,661,306 | 5/1972 | Kuckens . | |
| 3,779,413 | 12/1973 | Pickerell et al. | 215/11 |
| 3,834,597 | 9/1974 | Guala . | |
| 3,860,152 | 1/1975 | Marti . | |
| 3,912,115 | 10/1975 | Smith . | |
| 3,924,777 | 12/1975 | Peyser . | |
| 3,949,898 | 4/1976 | Patel et al. . | |
| 3,990,603 | 11/1976 | Brochman . | |
| 4,022,357 | 5/1977 | Dwinell . | |
| 4,179,044 | 12/1979 | Fitte . | |
| 4,211,334 | 7/1980 | Witten et al. . | |
| 4,234,103 | 11/1980 | Strobl et al. . | |
| 4,294,382 | 10/1981 | Summers et al. . | |
| 4,307,821 | 12/1981 | McIntosh . | |
| 4,340,147 | 7/1982 | McIntosh . | |
| 4,356,939 | 11/1982 | Fitte . | |
| 4,483,464 | 11/1984 | Nomura . | |
| 4,583,665 | 4/1986 | Barriac . | |
| 4,682,702 | 7/1987 | Gach . | |
| 4,696,415 | 9/1987 | Mueshberg . | |

(List continued on next page.)

FOREIGN PATENT DOCUMENTS

| | | |
|---|---|---|
| 747 294 A1 | 12/1996 | European Pat. Off. . |
| WO 96/14249 | 5/1996 | WIPO . |
| WO 97/00816 | 1/1997 | WIPO . |

*Primary Examiner*—Kevin Shaver
*Assistant Examiner*—Keats Quinalty
*Attorney, Agent, or Firm*—Rockey, Milnamow & Katz, Ltd.

[57] ABSTRACT

A dispensing structure is provided for a container that has an opening to the container interior. The dispensing structure includes a body for extending around the container opening and defining and access passage for access through the container opening. The body includes a chamber for receiving an additive product for adding to the container. The chamber has an initially closed upper end and has a bottom end defining a bottom end opening. A movable, bottom end closure is provided for releasably closing the chamber bottom end opening. A deformable cover is mounted to the body to accommodate deformation from an undeformed condition at which the bottom end closure closes the chamber bottom end opening to a deformed condition at which the bottom end closure is engaged and moved by the cover to a position that opens the chamber bottom end opening.

29 Claims, 6 Drawing Sheets

U.S. PATENT DOCUMENTS 4,709,822 12/1987 Vataru .
4,722,449 2/1988 Dubach .
4,727,999 3/1988 Gach .
4,728,006 3/1988 Drobish et al. .
4,747,501 5/1988 Greaves .
4,749,108 6/1988 Dornsbusch et al. .
4,770,305 9/1988 Su .
4,785,931 11/1988 Weir et al. .
4,795,043 1/1989 Odet et al. .
4,807,769 2/1989 Gach .
4,817,816 4/1989 Leseman et al. .
4,846,236 7/1989 Deruntz .
4,867,326 9/1989 O'Meara .
4,869,399 9/1989 Dubach .
4,909,434 3/1990 Jones et al. .
4,948,003 8/1990 Munoz .
4,969,581 11/1990 Seifert et al. .
4,993,569 2/1991 Osip et al. .
5,005,737 4/1991 Rohr .
5,008,066 4/1991 Mueller .
5,042,690 8/1991 O'Meara .
5,090,582 2/1992 Art et al. .
5,115,950 5/1992 Rohr .
5,133,486 7/1992 Moore et al. .
5,213,236 5/1993 Brown et al. .
5,255,812 10/1993 Hsu .
5,271,531 12/1993 Rohr et al. .
5,280,764 1/1994 Levinrad .
5,292,025 3/1994 Dubreul .
5,356,018 10/1994 Dubach .
5,386,918 2/1995 Neveras .
5,400,912 3/1995 Brown et al. .
5,419,445 5/1995 Kaesemeyer ..... 215/DIG. 8
5,427,260 6/1995 Mueller et al. .
5,437,382 8/1995 Gluckman .
5,439,124 8/1995 Mock .
5,439,143 8/1995 Brown et al. .
5,462,200 10/1995 Weiler .
5,469,980 11/1995 O'Meara et al. .
5,482,176 1/1996 Maietta et al. .
5,501,348 3/1996 Takeuchi .
5,503,282 4/1996 Montgomery .
5,505,326 4/1996 Junko .
5,531,363 7/1996 Gross et al. .
5,547,091 8/1996 Neveras et al. .
5,566,859 10/1996 Willis et al. .
5,593,028 1/1997 Haber et al. ..... 215/DIG. 8
5,642,824 7/1997 Hess, III et al. .
5,642,838 7/1997 Stoody .
5,794,802 8/1998 Caola ..... 215/DIG. 8
5,839,573 11/1998 Morini ..... 215/DIG. 8
5,863,126 1/1999 Guild ..... 215/DIG. 8

DISPENSING STRUCTURE WITH AN OPENABLE MEMBER FOR SEPARATING TWO PRODUCTS

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a system or structure for dispensing a product from a container. The dispensing structure is particularly suitable for use in storing an additive or additional ingredient which can be initially maintained separated from material in a container and subsequently mixed with the material in the container.

BACKGROUND OF THE INVENTION AND TECHNICAL PROBLEMS POSED BY THE PRIOR ART

A variety of container closures have been designed to accommodate opening of the closure by pulling or breaking a portion of a membrane across the container opening. While such closures may function generally satisfactorily in the applications for which they have been designed, it would be desirable to provide an improved dispensing system or dispensing structure which can be even more easily used.

Further, it would be advantageous if such an improved dispensing structure could accommodate the separate storage of an additive or ingredient for subsequent mixing with another material in the container.

Further, it would be beneficial if such improved dispensing structure could provide a readily releasable system for maintaining the structure in a sealed closed position and for providing evidence of tampering or evidence of an initiation of the closure opening process.

Additionally, it would be desirable to provide an improved closure that could, if desired, readily accommodate a design in which a frangible sealing system across the dispensing opening can be incorporated solely within a closure structure which is separate from the container to which the closure structure is attached. Advantageously, such a dispensing closure or dispensing structure should provide a very effective seal when the dispensing structure is closed (1) so as to avoid subjecting the material in the container (and/or the interior dispensing structure) to prolonged exposure to the ambient atmosphere, and (2) so as to prevent contamination of the materials within the container by preventing contaminant ingress.

Such an improved dispensing structure should also accommodate designs which permit incorporation of the dispensing structure as a unitary part, or extension, of the container and which also accommodate separate mounting of the dispensing structure on the container in a secure manner.

It would also be beneficial if such an improved dispensing structure could readily accommodate its manufacture from a variety of different materials.

Further, it would be desirable if such an improved dispensing structure could be provided with a design that would accommodate efficient, high-quality, large volume manufacturing techniques with a reduced product reject rate.

Preferably, the improved dispensing structure should also accommodate high-speed manufacturing techniques that produce products having consistent operating characteristics unit-to-unit with high reliability.

The present invention provides an improved dispensing structure which can accommodate designs having the above-discussed benefits and features.

BRIEF SUMMARY OF THE INVENTION

According to one aspect of the present invention, a dispensing structure is provided for a container that has an opening to the container interior. The dispensing structure includes a body for extending around the container opening. The body defines an access passage for establishing communication through the container opening. The body includes a chamber for receiving an additive product for adding to the contents within the container. The chamber has an initially closed upper end and has a bottom end defining a bottom end opening which is initially closed.

According to one aspect of the invention, a movable closure means is provided for releasably closing the chamber bottom end opening. The dispensing structure also includes a deformable cover means for mounting to the body to accommodate deformation from an undeformed condition, at which the movable closure means closes the chamber bottom end opening, to a deformed condition at which the movable closure means is engaged and moved by the cover means to a position that opens the chamber bottom end opening.

According to another aspect of the invention, the dispensing structure includes a bottom end closure member which is movable between (1) a closed position occluding the chamber bottom end opening, and (2) an open position away from the closed position. A vertically movable push member is provided and is disposed in the chamber. The push member has an upper end. The push member has a lower end which is adapted to move the bottom end closure member from the closed position to the open position when the push member is pushed downwardly. At least one flexible support arm is connected at one end with the body and at the other end with the push member. The flexible support arm is normally biased to an upwardly displaced configuration. The flexible support arm accommodates movement of the support art and push member to a downwardly displaced configuration.

A cover is provided for accommodating movement between (1) a closed position over the body, and (2) an open position away from the closed position. The cover includes a peripheral frame for mounting on the body. The cover also has a top that (i) has interior and exterior surfaces, (ii) is connected with the frame, (iii) is normally biased to an upwardly convex configuration as viewed from outside the cover, and (iv) accommodates flexure of the top to a self-maintained, inverted, downwardly concave configuration for moving the flexible arm and push member to the downwardly displaced configuration. The cover also has an actuating member which projects from the top interior surface and which is adapted to push the push member downwardly when the cover top is moved to the inverted, downwardly displaced configuration.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 4 shows the closure housing lid or cover in the fully open condition;

FIG. 6 shows portions of the insert sleeve broken away to illustrate interior detail;

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the dispensing structure of this invention is described in the normal (upright) operating position, and terms such as upper, lower, horizontal, etc., are used with reference to this position. It will be understood, however, that the dispensing structure of this invention may be manufactured, stored, transported, used, and sold in an orientation other than the position described.

Figure 1:
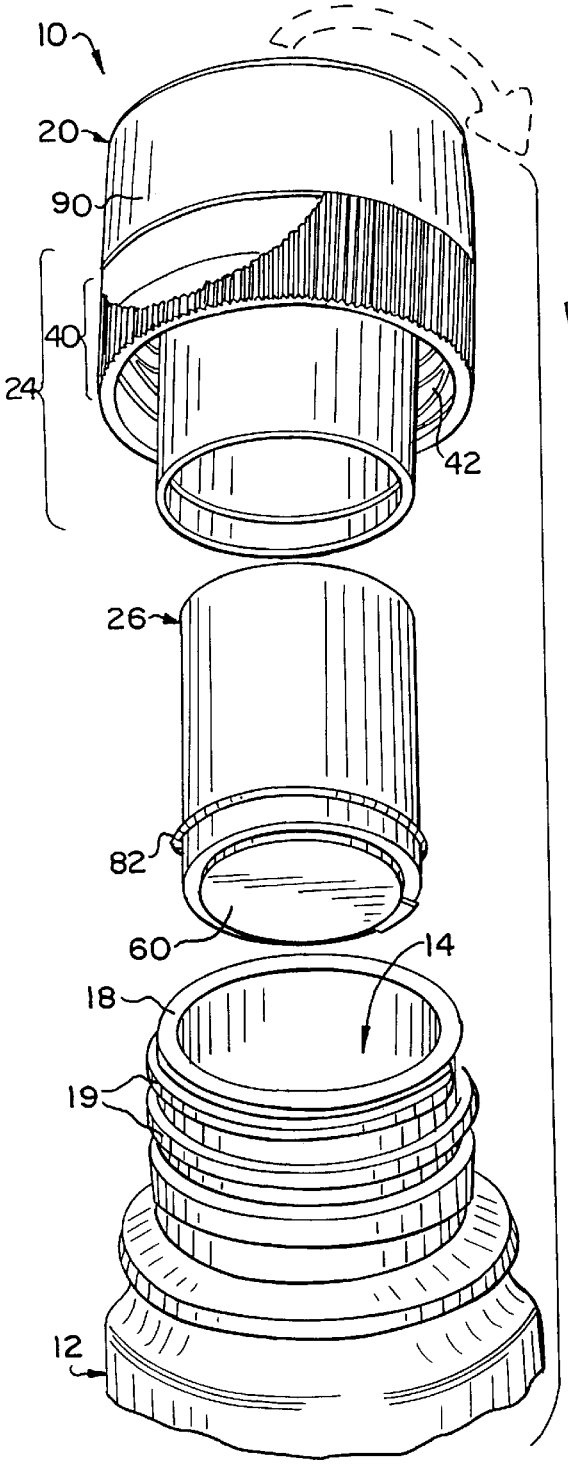
FIG. 1 is an exploded, perspective view of a dispensing structure of the present invention in the form of a dispensing closure which can be mounted on the upper end of a container, and the dispensing closure components are shown in FIG. 1 in an initially closed condition.
Figure 2:
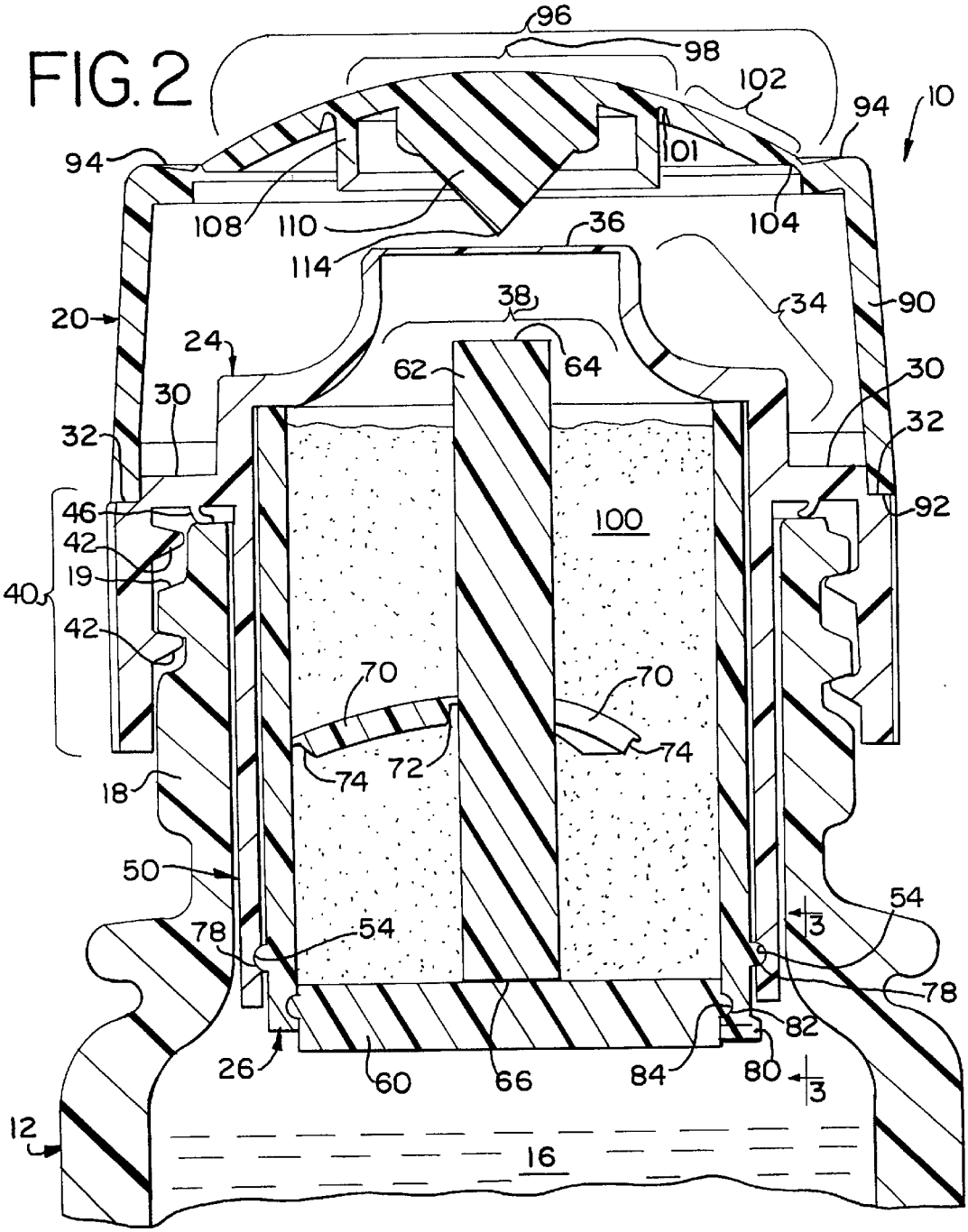
FIG. 2 is an enlarged, fragmentary, cross-sectional view of the fully assembled closure mounted on the container in a closed condition and containing an additive material in an interior chamber.
Figure 7:
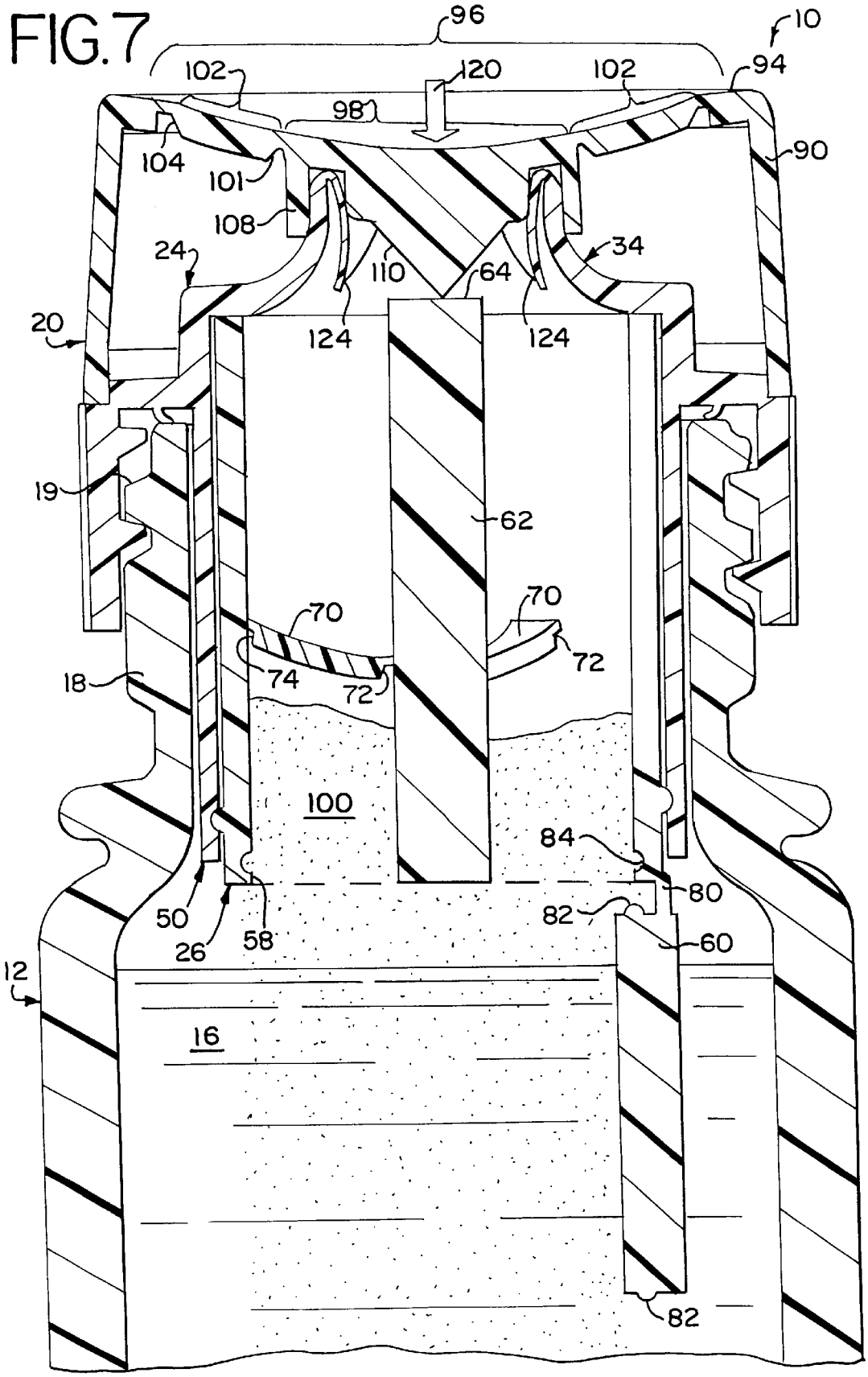
FIG. 7 is a view similar to FIG. 2, but FIG. 7 shows a downward force being applied to the closed lid or cover so as to force lid or cover downwardly relative to the closure housing body so as to push the insert sleeve push member downwardly to open the bottom end closure member.

One presently preferred embodiment of the dispensing structure of the present invention is illustrated in FIGS. 1, 2, and 7 in the form of a dispensing closure designated generally in the figures by the reference number 10. The dispensing structure or closure 10 is provided as a separate manufactured assembly of components for mounting to the top of a container 12 (FIG. 1). It will be appreciated, however, that it is contemplated that in some applications it may be desirable for the dispensing structure 10 to be formed as a unitary part, or extension, of the container 12.

The container 12 has a conventional mouth or opening 14 (FIG. 1) which provides access to the container interior and a product 16 (FIGS. 2 and 7) contained therein. The product 16 may be, for example, a liquid comestible product. The product 16 could also be any other solid, liquid, or gaseous material, including, but not limited to, a food product, a personal care product, an industrial or household cleaning product, a paint product, a wall patch product, other chemical compositions (e.g., for use in activities involving manufacturing, commercial or household maintenance, construction, remodeling, and agriculture), etc.

The container 12 may typically have a neck 18 (FIGS. 1 and 2) or other suitable structure defining the container mouth or opening 14 (FIG. 1). The neck 18 may have (but need not have) a circular cross-sectional configuration, and the body of the container 12 may have another cross-sectional configuration, such as an oval cross-sectional shape, for example. The container 12 may, on the other hand, have a substantially constant shape along its entire length or height without any neck portion of reduced size or different cross section. In the embodiment illustrated in FIG. 1, the container neck 18 defines a male thread 19.

The container 12 may typically be a squeezable container having a flexible wall or walls which can be grasped by the user and compressed to increase the internal pressure within the container so as to squeeze the product 16 out of the container through the closure 10 when the closure 10 is open. Such a container wall typically has sufficient, inherent resiliency so that when the squeezing forces are removed, the container wall returns to its normal, unstressed shape. Such a structure is preferred in many applications, but may not be necessary or preferred in other applications. Indeed, the container 12 may be substantially rigid.

The dispensing structure or closure 10 includes an outer lid or cover 20 and an underlying body 24. In the preferred embodiment, the body 24 is a multi-component assembly which includes a separate insert sleeve 26 (FIG. 1). The body 24 holds an additive material 100 which can ultimately be mixed with the product 16 in the container 12.

Figure 4:
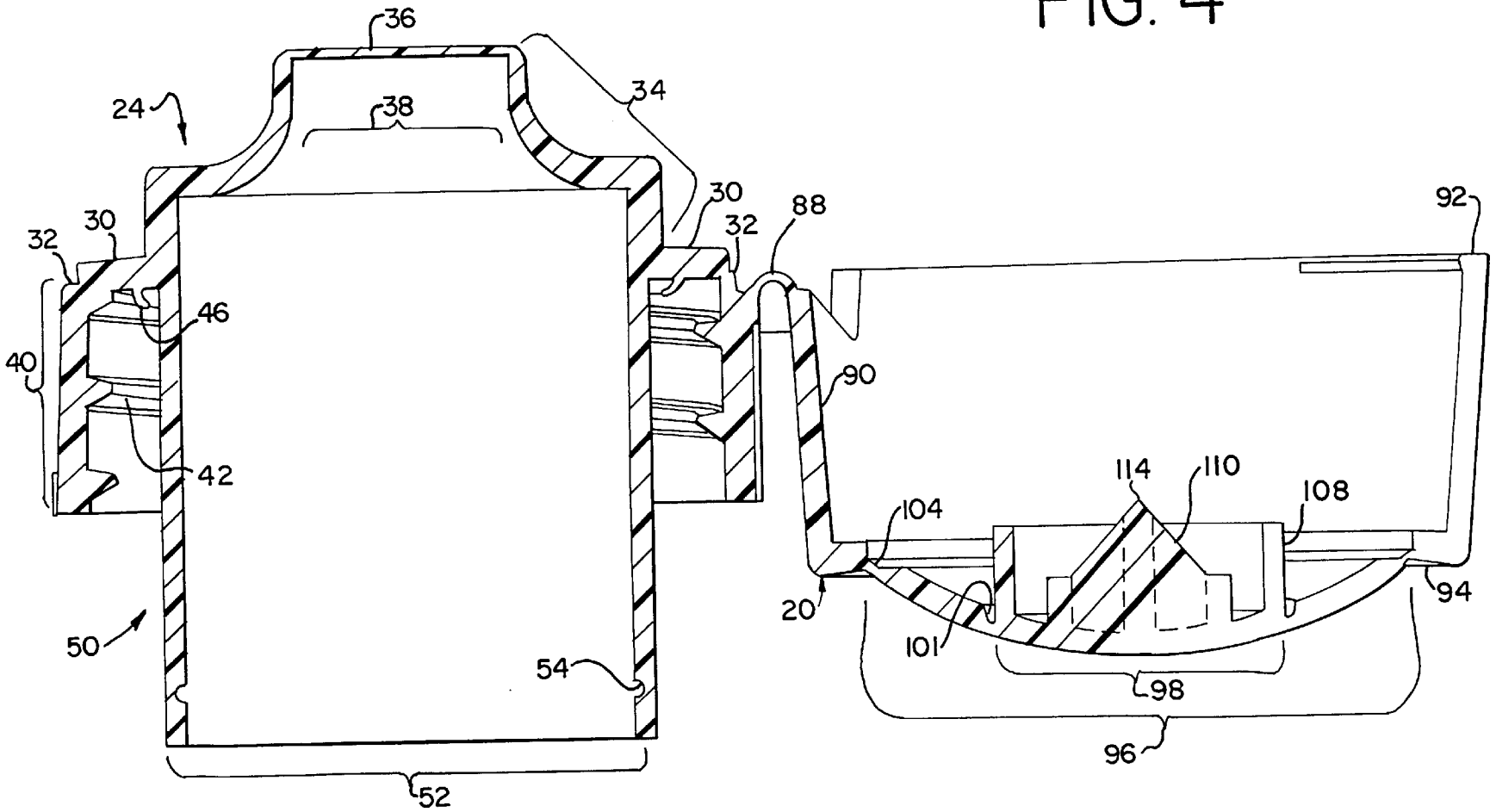
FIG. 4 is a cross-sectional view of the closure housing with the insert sleeve omitted.

As shown in FIG. 4, the body 24 has a peripheral deck 30 with a surrounding stepped down shoulder 32 against which the bottom of the cover 20 closes (see FIG. 2). Projecting upwardly from the deck 30 is a spout or upper end 34 (FIG. 2) which defines an access passage 38 that communicates through the body 24 with the container opening 14 and that is initially sealed closed with a pierceable membrane 36. In the preferred embodiment illustrated, the membrane 36 is a unitary molded portion of the closure body 24.

The closure body 24 defines an outer housing or lower skirt 40 which has suitable connecting means, such as a conventional female thread 42 as shown in FIG. 4, or a conventional snap-fit bead (not illustrated), for engaging a suitable container cooperating means, such as the container thread 19 (or bead, not shown) to secure the closure body 24 to the neck 18 of the container 12.

The closure body 24 and container 12 could also be releasably attached by other means. Alternatively, the closure body 24 may be permanently attached to the container 12 by means of induction melting, ultrasonic melting, gluing, or the like, depending upon the materials employed for the container and closure. Further, as previously mentioned, the closure could, in some applications, be formed as a unitary part, or extension, of the container 12.

At the top of the closure skirt 40, the deck 30 extends radially inwardly. Preferably, an annular, flexible, "crab's claw"-shaped seal 46 (FIG. 4) projects from the lower portion of the closure housing deck 30 adjacent the upper end of the container neck 18 so as to provide a leak-tight seal between the closure body 24 and the container neck 18 (FIG. 2). Of course, other types of closure body/container seals may be employed. Also, if air tightness is not required, no closure body/container seal 46 need be employed.

FIG. 4 shows that the closure body 24 includes an inner, annular housing 50 that is adapted to extend into the container opening (as seen in FIG. 2). The inner housing 50 includes (1) a lower end 52 defining an opening, and (2) the body upper end or spout 34 which defines the access passage 38 that is initially closed over with the pierceable membrane 36. Thus, the inner housing 50 may be characterized as defining at least a portion of the body access passage 38 which communicates with the interior of the container 12 through the lower end 52. In the preferred embodiment illustrated in FIGS. 1–7, there is an annular groove 54 defined on the inside surface of the inner housing 50 near the open lower end 52. The lower open end 52 may be regarded as part of, and a continuation of, the access passage 38 which is defined by the closure body 24.

With reference to FIG. 1, the insert sleeve 26 may be characterized as a component or part of the closure body 24. The insert sleeve 26 is shown in more detail in FIG. 6. The insert sleeve 26 is adapted to be inserted into, and received in, the closure body inner housing 50 (as shown in FIGS. 2 and 7).

Figure 6:
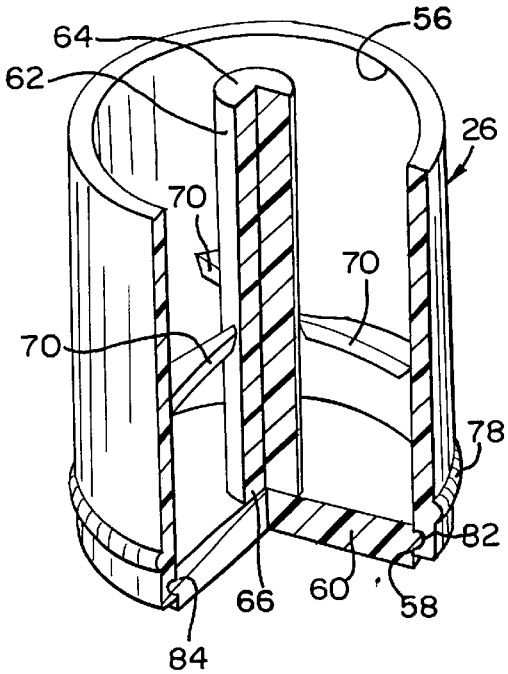
FIG. 6 is a perspective view of the insert sleeve prior to being filled with an additive material and prior to assembly in the closure housing.

The insert sleeve 26, when inserted in the inner housing 50 of the closure body 24, also defines at least a portion of the access passage 38 which extends through the inner housing 50. As shown in FIG. 6, the insert housing 26 has an upper end opening 56, and the insert housing 26 has a lower end opening 58 which is initially closed or occluded by a bottom end closure member 60.

The insert sleeve 26 includes a movable push member 62. The push member 62 is vertically movable and has an upper end 64. The push member 62 has a lower end 66 which is adapted to bear against, and ultimately move, the bottom end closure member 60 away from its initially closed position (FIG. 6) when the push member 62 is pushed downwardly as explained in detail hereinafter.

The insert sleeve 26 includes three flexible support arms 70. Each support arm 70 is connected at one end with the insert sleeve 26 and at the other end with the push member 62. Each flexible support arm 70 is normally biased to an upwardly displaced configuration (as illustrated in FIGS. 2 and 6). Each flexible support arm 70 accommodates movement of the support arm 70 and push member 62 to a downwardly displaced configuration (as shown in FIG. 7) in a manner described in detail hereinafter. As shown in FIG. 2, each flexible support arm 70 includes a first, reduced thickness cross section region 72 at the push member 62, and the reduced thickness cross section region 72 defines a hinge that accommodates flexure of the support arm toward a self-maintained condition in the downwardly displaced configuration (FIG. 7).

Each flexible support arm 70 preferably includes a second reduced thickness cross section region 74 at the cylindrical peripheral wall of the insert sleeve 26. The reduced thickness cross section region 74 defines a hinge that accommodates flexure of the support arm 70 to a self-maintained condition in the downwardly displaced configuration (FIG. 7).

The exterior surface of the cylindrical wall of the insert sleeve 26 defines a radially projecting bead 78 for mating with the groove 54 defined in the closure inner housing 50 when the insert sleeve 26 is inserted into, and assembled with, the closure body 24 as shown in FIG. 2. The components, typically molded from thermoplastic material, have sufficient flexibility to accommodate movement of the insert sleeve bead 78 into the bottom end of the closure body inner housing 50 to effect a snap-fit engagement of the bead 78 with the groove 54. Typically, prior to insertion of the insert sleeve 26 into the closure body 24, the insert sleeve 26 is filled with the additive material 100. The snap-fit engagement between the insert sleeve bead 78 and closure body inner housing groove 54 also provides a seal preventing leakage from, or into, the container 12 between the exterior of the insert sleeve 26 and the interior of the closure body inner housing 50.

Figure 3:
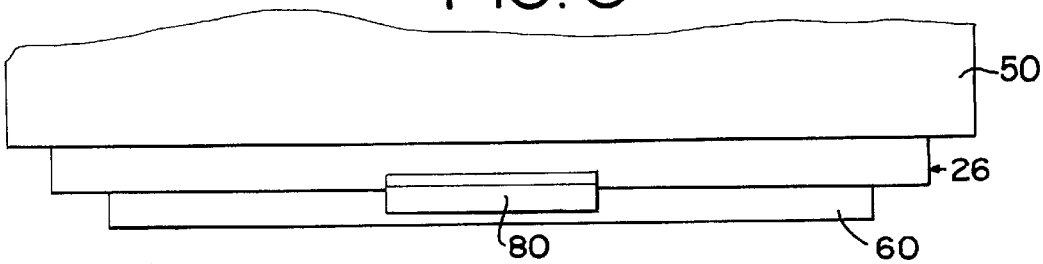
FIG. 3 is an enlarged, fragmentary side elevational view of a portion of the dispensing closure taken along the plane 3—3 of FIG. 2.

The bottom end closure member 60 is preferably molded as a unitary part of the insert sleeve 26 and is connected to the bottom end of the cylindrical sleeve wall with a unitary flexible hinge 80 (FIG. 3). The periphery of the bottom end closure member 60 has an outwardly projecting bead 82 (FIG. 6). Adjacent the bottom end of the insert sleeve 26, the inner surface of the cylindrical wall of the insert sleeve 26 defines a peripheral groove 84 (FIG. 26) formatingly receiving the annular bead 82 on the bottom end closure member 60. The insert sleeve 26 is sufficiently flexible to accommodate movement of the bottom end closure member bead 82 into a snap-fit engagement with the groove 84.

Typically, the insert sleeve 26 is molded as a separate component with the unitary hinge 80 and bottom end closure member 60 in an open position (similar to the position shown in FIG. 7, but with the closure member 60 rotated 90° further counterclockwise). After the insert sleeve 26 is molded in the open condition, the bottom end closure member 60 is pivoted upwardly into the snap-fit, closed position illustrated in FIGS. 2 and 6. Subsequently, the insert sleeve 26 can be filled with the product 100 prior to inserting the filled insert sleeve 26 into the closure body inner housing 50 (FIG. 2). The engagement between the bottom end closure member bead 82 and the insert sleeve groove 84 provides a seal to prevent leakage of the container product 16 into the additive product 100 within the sleeve chamber and/or to prevent leakage of the additive 100 into the container product 16.

The closure body inner housing 50 and the insert sleeve 26, when assembled, together define a chamber for receiving and containing the additive product 100. Because the upper end of the closure body inner housing 50, comprising the spout 34 and membrane 36, is sealed closed over the top of the insert sleeve 26, the inner housing 50 may be regarded as defining part of the chamber.

Thus, the closure body inner housing 50 may be regarded as defining at least a portion of the body access aperture 38 as well as at least a portion of the chamber, and the body insert sleeve 26 may be regarded as defining at least a portion of the access passage 38 and at least a portion of the chamber.

In another contemplated embodiment, the insert sleeve 26 need not be a separate component. Rather, the closure body 24 may be molded as a unitary structure defining an interior chamber. In such a unitary structure, the insert sleeve cylindrical wall, per se, could be eliminated and the bottom end closure member 60 could be attached through a unitary hinge directly to the bottom end of the inner housing 50. In such an alternate embodiment, the flexible support arms 70 would be directly connected to, and molded with, the inner housing 50. In such an alternative embodiment, the chamber could be initially filled with additive product 100 by inverting the closure body and pouring the additive material 100 into the inverted closure body through the open bottom end prior to closing the closure member 60 into the bottom of the inner housing 50.

In any case, whether or not a separate insert sleeve 26 is employed, the additive material 100 in the chamber may be a powder which is intended to be mixed with a liquid product 16 in the container 12 to form a solution or mixture. Such a system may be especially desirable where two different materials are to be mixed together to form a useful composition, but where such materials must be stored separately prior to use because of chemical reactivity or physical incompatibility during the storage. Such resulting compositions may include, for example, health and beauty aids, cleaning compositions, dental formulas, food products, adhesives, paints, and especially compositions wherein the efficacy rapidly degrades with time following mixing.

The closure cover 20 has a skirt 90 (FIGS. 1, 2, and 4) which defines a bearing surface 92. As shown in FIG. 2, the cover bearing surface 92 is adapted to seat on the closure body lower, outer shoulder 32 when the cover 20 is closed. On one side of the closure 10, the cover skirt 90 is joined with a hinge 88 to the closure body 24. About 180 degrees from the hinge 88, the user may push upwardly on the cover skirt 90 with a finger to lift the cover 20.

As shown in FIG. 4, the closure body 24 is preferably connected through a hinge 88 which is unitary with the cover 20. The hinge 88 extends from the upper portion of the closure body outer housing 40 to the skirt portion 90 of the cover 20. Preferably, the hinge 88 is a snap-action type hinge formed integrally with the cover 20 and closure body 24 in a unitary structure. The illustrated snap-action hinge 88 may be a conventional type as described in U.S. Pat. Nos. 4,403,712 or 5,642,824. Other hinge structures may be employed, including a "floppy" living film hinge. If desired, a hinge need not be employed. Rather, the cover 20 may be a separate component. However, it is preferable to employ a snap-action hinge which can hold or maintain the cover 20 in the open position (FIG. 2) during the dispensing of the container contents at the application site.

The closure body 24 (and hinge 88 and cover 20, if provided as a unitary part thereof) may be molded from a synthetic, polymeric material, or other materials, compatible with the container contents.

Figure 5:
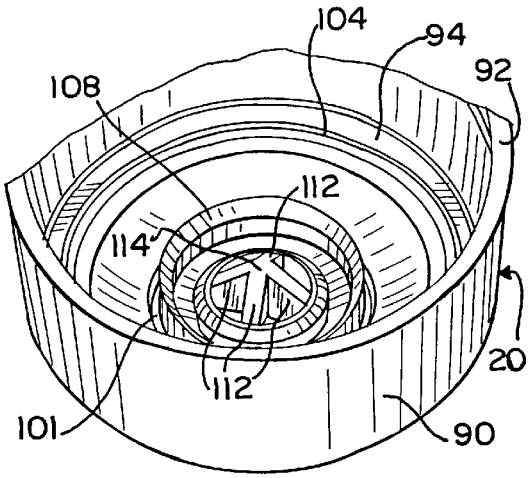
FIG. 5 is a fragmentary perspective view of the inside of the open lid or cover.

The outer, or upper, end of the cover skirt 90 terminates in an annular flange or shoulder 94 (FIGS. 2 and 5). Together, the shoulder 94 and skirt 90 constitute a peripheral frame from which a convex top 96 extends (FIG. 2). The top 96 is characterized as being generally "convex" in an initially, unactuated position as shown in FIG. 2 when viewed from the exterior of the cover 20. The top 96 is normally biased to the outwardly convex configuration and accommodates flexure of the top 96 to a self-maintained, inverted, inwardly concave configuration (FIG. 7).

In the preferred embodiment as shown in FIG. 2, the top 96 includes central region 98, and a first annular hinge 101 joining the central region 98 with an annular region 102, and a second annular hinge 104 joining the annular region 102 with the shoulder 94 (which shoulder 94, together with the cover skirt 90, defines the peripheral frame of the cover 90). Each annular hinge 101 and 104 includes a reduced thickness section of material defined by a notch which opens inwardly toward the inside of the cover 20.

In the preferred embodiment, an annular sealing collar 108 (FIG. 2) extends inwardly from the periphery of the top central region 98 for sealingly receiving the closure body spout 34 when the cover 20 is deflected downwardly in the closed position (FIG. 7). Extending inwardly from the inside of the top central region 98 is an actuating member 110 which includes four intersecting webs 112 (FIG. 5) defining a piercing point 114. The point 114 is adapted to pierce the membrane 36 and to engage the top end 64 of the push member 62. The push member 62 is pushed downwardly and forces the closure member 60 out of its snap-fit engagement with the sleeve 26. The closure member 60 then falls open (FIG. 7) under the influence of gravity, and the additive material falls into the container 12.

The cover top hinges 101 and 104 accommodate movement of the annular region 102 from the self-maintained, outwardly convex configuration (FIG. 2) to a self-maintained, inverted, inwardly concave configuration (FIG. 7) when the exterior surface of the cover central region 98 is subjected to a downwardly directed force represented by the arrow 120 in FIG. 7. Typically, a user would push down on the central region 98 with the heel or palm of the user's hand or with the thumb or a finger of the user's hand. The downward movement of the closure body actuating member 110 effects a piercing or severing of the membrane 36 and subsequent pushing of the push member 62 downwardly. In the fully actuated configuration as illustrated in FIG. 7, the components remain in that position owing to the self-biasing nature of the inverted cover annular region 102 and annular hinges 101 and 104, and owing to the self-biasing nature of the inverted support arms 70.

The cover top 96 (FIG. 2) has two stable positions—the outwardly convex configuration illustrated in FIG. 2, and the inwardly concave configuration illustrated in FIG. 7. At any position between the two stable positions, the top 96 is in compression and exhibits a resistance to movement between the two stable positions. The degree of resistance to movement may be defined, at least in part, by the difference between the total exterior surface area of the convex top 96 within the outer annular hinge 104 and the theoretical area of a planar circle defined by the outer annular hinge 104. As the top 96 is pushed from one stable position to the other stable position, the resistance to movement is overcome by resilient compressive bowing and distortion which is accommodated by the resilient material of the cover 20 (which may be polypropylene, for example) and by the film hinges 101 and 104.

Owing to the configuration of the actuating member 110, the penetration of the membrane 36 results in the formation of downwardly hanging flap portions 124 (FIG. 7). The interior of the container 12 is then in an unsealed condition and is exposed to the underside of the closed cover 20 through the penetrated membrane 36 and open bottom end of the sleeve 26. The user can then shake the package to mix the additive 100 and product 16.

Next, the cover 20 can be lifted upwardly by the user to open the closure 10. Owing to the friction between the exterior surface of the spout 34 and cover sealing collar 108, the closure body flexible top 96 remains in the inwardly displaced configuration (FIG. 7) as the cover collar 108 slides upwardly and away from the closure body spout 34. Subsequently, the opened closure package can be inverted to accommodate the dispensing of the mixed product and additive out of the container through the open spout 34. In the preferred embodiment, where the hinge 88 (FIG. 4) is a snap-action type of hinge, the cover 20 is generally held in a self-maintained open position by the hinge 88.

The unique structure of the cover top 96 described above provides a large surface area upon which the user may exert a force to invert the top 96 and internal push member support arms 70 when puncturing the membrane 36 and opening the bottom closure member 60. The cover top 96 provides a number of functions. First, the top 96 provides a large bearing surface for user comfort during application of force to actuate the closure 10 when opening the membrane 36. Second, the top 96 provides an attachment means for the dispensing aperture sealing collar 108. Third, the top 96 provides the two-position biasing feature for holding the closure cover 20 in the self-maintained, outwardly convex configuration and in the self-maintained, inverted, inwardly concave configuration. Finally, owing to the self-biasing nature of the top 96 as it snaps from one stable position through its range of motion to the other stable position, the top 96 functions as a force-enhancing means for actuation of the closure 10. In particular, it will be appreciated that as the top 96 moves from its outwardly convex configuration (FIG. 2) to its inverted, inwardly concave configuration (FIG. 7), the top 96 passes through a point of maximum distortion and stress which provides a maximum spring force. This has a tendency to accelerate the movement of the top 96 toward the inwardly concave configuration. This acceleration enhances the force exerted by the user on the closure cover 20, and this enhances the piercing force of the actuating member 110 on the membrane 36 and push member 62.

Once the cover 20 has been actuated to the self-maintained, inverted, inwardly concave configuration (FIG. 7), the cover 20 remains in that configuration—even when the cover 20 is lifted upwardly to open the spout 34 because of the friction between the exterior of the spout and the surrounding cover sealing collar 108. Thus, the container 12, with an actuated closure 10 mounted thereon, can be stored, if desired, on a shelf or other surface in an upsidedown orientation supported by the cover shoulder 94. This permits the product within the container 12 to flow down to the region of the spout 34 under the influence of gravity so that the product can be readily discharged from the container 12 when the cover 20 is subsequently opened. This is especially useful with viscous products which can take a long time to flow from the bottom of a container 12 to the container spout 34.

The closure body insert flexible support arms 70, as attached to push member 62, together provide a number of functions. First, they provide a means for attaching and locating the push member 62 in the closure. Second, they provide a two-position biasing means for positioning the push member in the elevated position (FIG. 2) and in the lowered position (FIG. 7). Third, they provide a travel control means for controlling the movement of the push member 62 from the upwardly displaced configuration (FIG. 2) to the downwardly displaced configuration (FIG. 7). Finally, they function in cooperation with the push member 62, closure member 60, and the cover 20 to maintain the separation of the chamber additive 100 from the container product 16 before the bottom closure member 60 is opened.

The additive 100 may be initially provided in the closure 10 on the container 12, but the container 12 may be empty. For example, the container 12 might have a predetermined internal volume and may intended to be filled with a common, readily available diluent, such as water. The additive 100 could be a more expensive, special material that is prepackaged in the closure 10 and which retains its efficacy during storage in the closure 10 until the user desires to prepare a diluted solution. At that time, the closure 10 is unscrewed from the container 12, and the container 12 is then filled with a predetermined amount of diluent, such as water. Next, the closure 10 is screwed back onto the container 12 and actuated to sever the membrane 36 so that the additive 100 can be mixed with the diluent.

It is also contemplated that if an additive material 100 is used, such an additive material can be separately packaged in a bag (not illustrated) or other holder, and attached to the container 12 or closure 10. Further, the additive component or components could also be carried in an overcap (not illustrated) attached to the closure 10. The user could later place the additive inside the chamber in the closure 10. The user could then actuate the closure 10 to sever the membrane 36 and push the bottom end closure member 60 open so as to permit mixing of the additive 100 with the product 16 in the container 12. Such a packaging system and process might be desirable where the additive 100 is purchased separately from the container/closure assembly containing the product 16 but where the subsequent mixing of the additive 100 and product 16 should occur in a closed system to prevent splashing of the materials or of the resulting mixture which might damage the surroundings or cause harm if in contact with skin.

It will be appreciated that one aspect of the invention contemplates that the dispensing structure includes a body for extending around the container opening and defining a chamber for receiving an additive product, a movable closure means for releasably closing the chamber bottom end opening, and a deformable cover means for mounting to the body to accommodate deformation from an undeformed condition in which the closure means closes the chamber body and opening to a deformed condition at which the closure means is engaged and moved by the cover means to a moved position that opens the chamber bottom end opening. The movable closure means includes, in the preferred embodiment illustrated in FIGS. 1–7, (1) the bottom end closure member 60, (2) the movable push member 62, and (3) at least one of the flexible support arms 70. Other equivalent structures could be substituted.

It will be appreciated that when the cover top 96 is inverted (FIG. 7), that condition provides an indication that the membrane 36 has been punctured and that the bottom end closure 60 has been opened. Similarly, the orientation of the cover top 96 in the outwardly convex configuration provides an indication that the seal membrane 36 has not been punctured and that the bottom end closure member 60 has not been opened. Thus, the condition of the cover top 96 provides a tamper-evident function. Of course, the condition of the seal 36 may also be more positively verified by lifting the cover 20 to observe the condition of the membrane 36. If the membrane 36 is observed to be pierced, then it is clear to the user that the contents of the chamber are no longer sealed.

To provide even more complete tamper evidency, shrink wrap films or tamper-evident tear bands may be provided between the cover 20 and the closure outer housing 40 and/or between the outer housing 40 and the container neck 18.

The container 12 and closure 10 may be normally stored in an upright orientation (as shown in the figures) wherein the closure 10 is at the top of the container. During such storage, the closure cover 20 may be either closed, or, in some cases, open. When the cover is closed after having been pushed into the inserted configuration (FIG. 7), the container 12 and closure 10 could be stored in an upsidedown position. When the assembly is stored in the upsidedown position, the inverted closure cover 20 functions as a support base.

Figure 8:
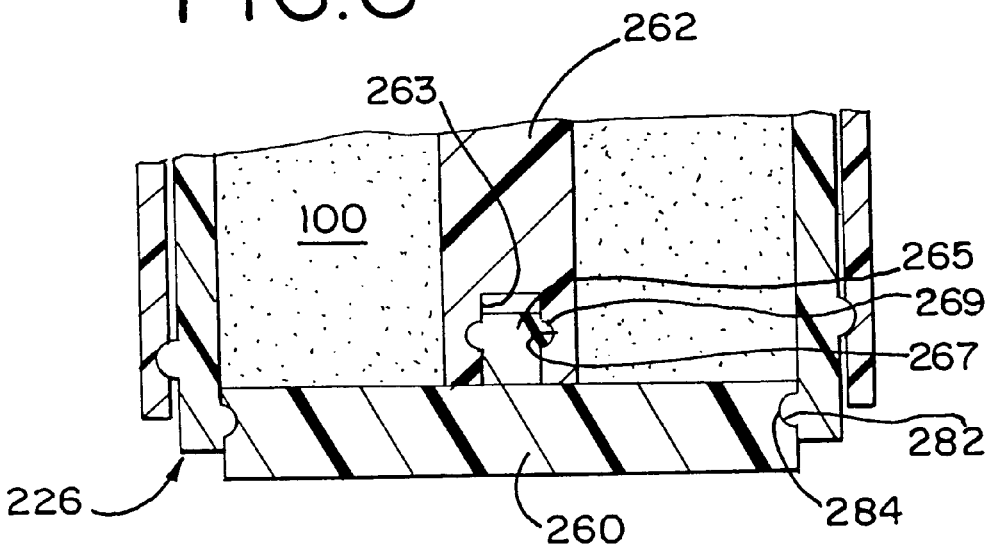
FIG. 8 is a fragmentary, cross-sectional view of a modified form of the insert sleeve.

A modification of the dispensing structure insert sleeve of the present invention is illustrated in FIG. 8. The modified form of the dispensing structure sleeve illustrated in FIG. 8 is designated generally in FIG. 8 by the reference number 226. The sleeve 226 has substantially the same structure as the sleeve 26 of the first embodiment described above with reference to FIGS. 1–7, except for the bottom end.

A bottom end closure member 260 is initially disposed in the lower end of the sleeve 226 in a manner that is similar to the arrangement of the first embodiment closure member 60 described above with reference to FIGS. 1–7. However, unlike the member 60, the bottom end closure member 260 is not hingedly connected to the bottom end of the sleeve 226. Rather, the closure member 260 is a separate element which is directly connected to an internal push member 262. The push member 262 is similar to the push member 62 described above for the first embodiment illustrated in FIGS. 1–7, except that the push member 262 has a modified lower end which includes a bore 263 for receiving a post 265 extending upwardly from the closure member 260. The bore 263 defines a radial groove 267 for receiving a bead 269 which projects radially outwardly from the closure member post 265. The closure member post bead 269 is snap-fit into engagement with the push member groove 267. The lower end of the push member 262 is sufficiently resilient in the region of the groove 267 to accommodate insertion of the closure member post bead 269 into the snap-fit engagement. The connection between the push member 262 and the bottom end closure member 260 is sufficient to hold the closure member 260 in a upwardly disposed, generally horizontal, closing relationship across the bottom end of the sleeve 226 as illustrated in FIG. 8.

Preferably, to provide a more effective seal between the periphery of the closure member 260 and the inside cylindrical surface of the sleeve 226, the sleeve 226 includes a radially inwardly extending bead 284, and the closure member 260 includes a peripheral groove 282 for receiving the bead 284 in a snap-fit engagement. The use of a bead on the sleeve and a groove on the closure member is opposite from the structure employed in the first embodiment illustrated in FIGS. 1–7 where the closure member 60 has a bead, and the sleeve has a groove. If desired, the modified form of the arrangement illustrated in FIG. 8 could include such a bead on the closure member 260 and a mating groove on the sleeve 226.

In any case, the push member 262 is normally supported in an upwardly displaced position, similar to the position of the first embodiment push member 62 illustrated in FIG. 2. As with the first embodiment of the push member 262 illustrated in FIG. 2, the modified form illustrated in FIG. 8 preferably includes a plurality of flexible support arms (not visible, but identical with the support arms 70 illustrated in FIG. 2) for holding the push member 262 in the upper position and for accommodating downward displacement of the push member to a lowered position (substantially identical with the lowered position of the push member 62 illustrated in FIG. 7). However, the amount of downward displacement of the push member 262 is somewhat greater than the amount of downward displacement of the first embodiment push member 62 so that when the push member 262 is forced to the downwardmost position by the cover actuating member, the bottom end closure member 260 will be spaced sufficiently far below the bottom of the sleeve 226 so as to provide an annular space through which the additive material 100 can pass as it falls into the container. To achieve such a greater downward displacement of the push member 262, the upper end of the push member 262 may extend somewhat higher and be closer to the cover actuating member compared to the first embodiment push member upper end 64 shown in FIG. 2. Further, the length of the push member support arms (not visible in FIG. 8 but similar to the arms 70 illustrated in FIG. 2) may be longer, and attached higher up on the support member, than the arms 70 in the first embodiment illustrated in FIG. 2.

Figure 9:
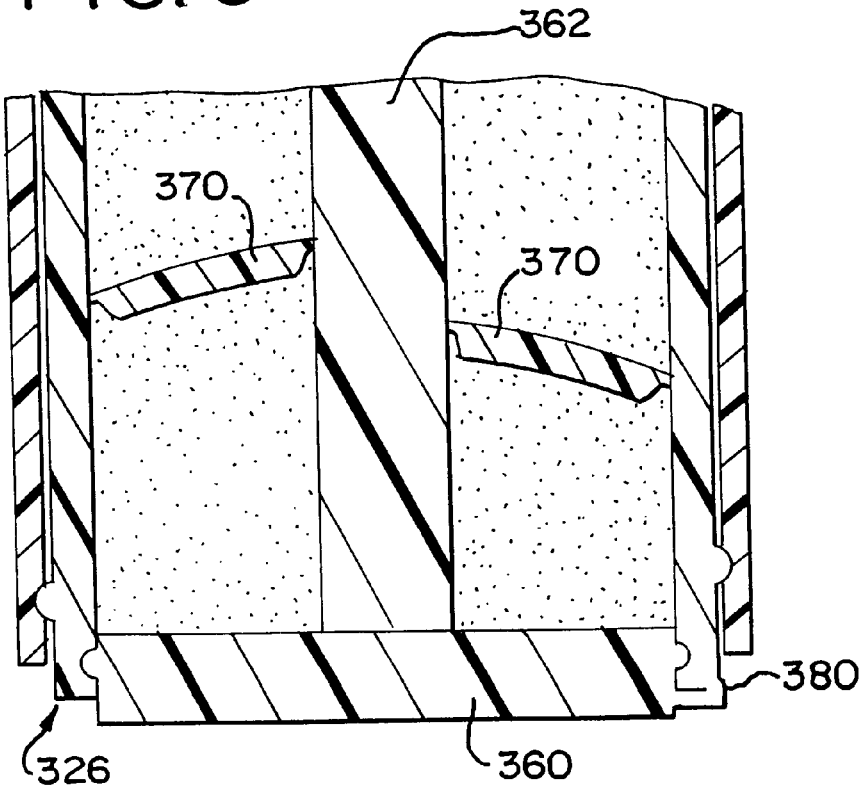
FIG. 9 is a fragmentary, cross-sectional view of another modified form of the insert sleeve.

Another modification of the dispensing structure of the insert sleeve 26 is illustrated in FIG. 9. The modified form of the dispensing structure sleeve illustrated in FIG. 9 is designated generally by the reference number 326. The sleeve 326 has a structure which is similar to the first embodiment of the sleeve 26 described above with reference to FIGS. 1–7 except that the modified form of the sleeve 326 includes a different arrangement of flexible support arms 370 extending between the cylindrical outer portion of the sleeve 326 and an internal push member 326. It can be seen in FIG. 9 that two of the support arms 370 are located at different elevations along the height of the push member 362. In contrast, with reference to FIG. 2, the first embodiment of the insert sleeve 26 includes support arms 70 which are at the same elevation. Although only two support arms 370 are visible in FIG. 9, one or more additional support arms 370 may also be provided. For example, one or more additional support arm may be provided at an intermediate elevation compared to the two support arms 370 which are visible in FIG. 9. A closure member 360 is snap-fit into the sleeve 326 with a bead and groove arrangement as in the first embodiment described above with reference to FIGS. 1–7.

Depending upon the azimuthal location of the support arms at different heights, the arrangement provides a directional control of the actuation of the push member 362. Specifically, it is possible to cause the push member 362 to move downwardly at an angle such that the bottom end of the push member 362 is tilted away from the closure member hinge 380. This will cause the bottom of the push member 362 to apply a force downwardly and outwardly with respect to the hinge 380 against the top surface of the closure member 360 to provide a greater opening force at the snap-fit connection between the closure member 360 and the sleeve 326 in a region about 180° from the hinge 380.

Figure 10:
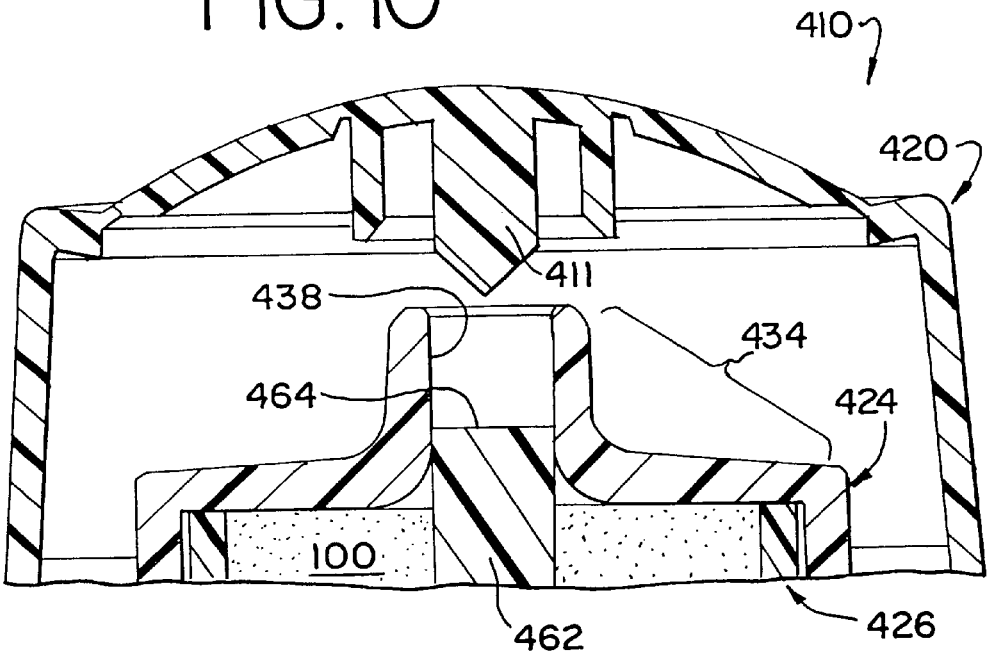
FIG. 10 is a fragmentary, cross-sectional view of another embodiment of the dispensing structure.

Another embodiment of the dispensing structure of the present invention is illustrated in FIG. 10. The dispensing structure is in the form of a closure designated generally by the reference number 410 in FIG. 10. The closure 410 includes a cover 420 which is substantially identical with the cover 20 described above with reference to the first embodiment illustrated in FIGS. 1–7. However, the embodiment of the closure 410 illustrated in FIG. 10 includes a modified closure body 424. The closure body 424 includes a spout 434 which defines an upper bore 438 defining a part of the access passage through the closure body 424. The bore 438 is not initially sealed with a membrane such as the membrane 36 described above with reference to the first embodiment illustrated in FIGS. 1–7. Rather, the closure body 424 includes an insert sleeve 426 which includes a push member 462 having an upper end 464 projecting into the bore 438 for initially occluding the bore 438. The cover 20 includes an actuating member 411 which is similar to the actuating member 110 described above with references to the first embodiment illustrated in FIGS. 1–7, but the actuating member 411 is longer and smaller in diameter. The actuating member 411 is adapted to be received within the bore 438 and engage the upper end 464 of the push member 462 when the cover 420 is actuated by pressing the central portion of the cover 420 downwardly. The top portion of the cover 420 is adapted to be deformed between the upwardly convex configuration illustrated in FIG. 10 and a downwardly deflected or inverted configuration (similar to the inverted configuration of the first embodiment cover 20 illustrated in FIG. 7). The lower portions of the sleeve 426 and push member 462 which are not visible in FIG. 10 may be identical with the lower portion of the sleeve 26 and push member 62, respectively, of the first embodiment described above with reference to FIGS. 1–7.

Figure 11:
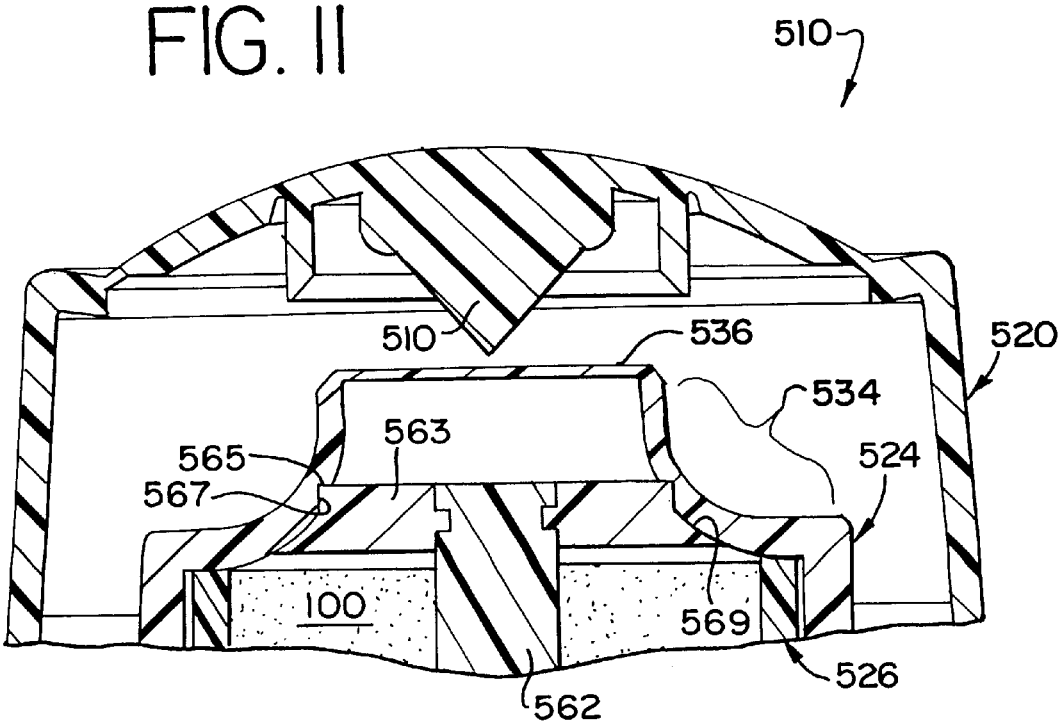
FIG. 11 is a fragmentary, cross-sectional view of yet another embodiment of the dispensing structure.

Yet a further embodiment of a closure incorporating the dispensing structure of the present invention is illustrated in FIG. 11 wherein the further embodiment is designated generally by the reference numeral 510. The closure 510 includes a cover 520 which is substantially identical with the cover 20 described above with reference to the first embodiment illustrated in FIGS. 1–7. The closure 510 includes a closure body 524 which is substantially identical with the closure body 24 described above with reference to the first embodiment illustrated in FIGS. 1–7. Thus, the closure body 524 includes a spout 534 and a membrane 536 which initially occludes the spout 534. However, in a modification of the closure 510 (which modified form is not illustrated), the membrane 436 may be omitted, and the top of the spout 534 may be open.

The closure body 524 is a multi-component body which includes an insert sleeve 526 which is similar to the sleeve 26 described above for the first embodiment illustrated in FIGS. 1–7. However, the insert sleeve 526 has a push member 562 with a modified upper end. Specifically, the upper end of the push member 562 includes a disk-like upper closure member 563. The upper closure member 563 may be a separately molded piece snap-fit into engagement with the upper end of the push member 562. Alternatively, the push member 562 and upper closure member 563 can be formed by injection molding to form an initially integral structure.

The upper closure member 563 can have a right angle upper peripheral edge 565, and the inside of the spout 534 can be provided with a mating sharp cornered groove 567 for receiving the upper closure member edge 565. The lower peripheral portion of the upper closure member 563 tapers and curves outwardly in an outwardly concave surface 569 to matingly and sealingly engage the inner curved surface of the spout 534.

The lower portion of the push member 562 is attached to the peripheral, cylindrical portion of the insert sleeve 526 by support arms (not visible in FIG. 11) which may be identical with the support arms 70 described above with reference to the first embodiment illustrated in FIGS. 1–7. The support arms maintain the push member 562 and the attached upper closure member 563 in the initially elevated position sealingly occluding the inside surface of the spout 534. This eliminates the need to provide a separate seal across the top of the spout 534, such as the membrane 536. However, the membrane 536 may be provided as an initial, secondary seal if desired.

When the cover 520 is actuated by pushing down on the top to invert the top (in the position similar to that illustrated for the first embodiment of the cover 20 in FIG. 7), the upper end of the push member 562 is engaged by the actuating member 510 on the cover and is pushed downwardly, and the flexible support arms (not visible) maintain the push member 562 and attached upper closure member 563 in a downwardly displaced position. This opens the inside of the spout 534. If a membrane 536 is employed, the actuating member 510 necessarily also penetrates the membrane 536 prior to engaging and pushing the push member 562 downwardly. As the push member 562 moves to the lowered position, the bottom end of the push member opens the bottom end closure member (not illustrated in FIG. 11, but identical with the closure member 60 described above with reference to the first embodiment illustrated in FIG. 7). The additive material is thus free to fall under the influence of gravity into the container where it can be mixed with the product in the container. The upper closure member is held below, and away from the spout 534, by the push member 562, and the mixed additive material and container product can then be poured from the package after opening the closure cover 520.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing structure for a container that has an opening to the container interior, said dispensing structure comprising:

a body for extending around said container opening and defining an access passage for access through said container opening, said body including a chamber for receiving an additive product for adding to said container, said chamber having an initially closed upper end and having a bottom end defining a bottom end opening;

a bottom end closure member movable between (1) a closed position occluding said chamber bottom end opening, and (2) an open position away from said closed position;

a vertically movable push member which (1) is disposed in said chamber, (2) has an upper end, and (3) has a lower end which is adapted to move said bottom end closure member from said closed position to said open position when said push member is pushed downwardly;

at least one flexible support arm that (1) is connected at one end with said insert sleeve and at the other end with said push member, (2) is normally biased to an upwardly displaced configuration, and (3) accommodates movement of said support arm and push member to a downwardly displaced configuration; and a cover for accommodating movement between (1) a closed position over said body, and (2) an open position away from said closed position, said cover including (a) a peripheral frame for mounting on said body, (b) a top that (i) has interior and exterior surfaces, (ii) is connected with said frame, (iii) is normally biased to an outwardly convex configuration as viewed from outside said cover, and (iv) accommodates flexure of said top to a self-maintained, inverted, downwardly concave configuration for moving said at least one flexible arm and push member to said downwardly displaced configuration, and (c) an actuating member which projects from said top interior surface and which is adapted to push said push member downwardly when said cover top is moved to said inverted, downwardly displaced configuration.

2. The dispensing structure in accordance with claim 1 in which said body is a multi-component assembly which includes at least (1) an inner housing that (i) is adapted to extend into said container opening, (ii) defines at least a portion of said body access passage and at least a portion of said chamber, (iii) has an upper end initially closed over said access passage, and (iv) has an open lower end, and (2) an insert sleeve which (i) is disposed in said inner housing for defining at least a portion of said access passage and at least a portion of said chamber, (ii) has an upper end opening, and (iii) has a lower end opening defining said chamber bottom end opening;

said bottom end closure member is adapted to occlude said insert sleeve lower end opening when said bottom end closure member is in said closed position; and said support arm is connected at one end with said sleeve and supports said push member inside said sleeve.

3. The dispensing structure in accordance with claim 2 in which said bottom end closure member is hingedly connected to said insert sleeve.

4. The dispensing structure in accordance with claim 2 in which said insert sleeve is snap-fit into said body inner housing.

5. The dispensing structure in accordance with claim 1 in which said dispensing structure body is separate from said container and includes an outer housing with an interior thread for threadingly engaging an exterior thread on said container.

6. The dispensing structure in accordance with claim 1 in which said body includes a membrane initially closing over said access passage; and said actuating member includes a penetrating point for penetrating said membrane when said cover is moved to said inverted, downwardly displaced configuration.

7. The dispensing structure in accordance with claim 1 in which said support arm includes at least one reduced thickness cross section region defining a hinge that accommodates flexure of said support arm to a self-maintained condition in said downwardly displaced configuration.

8. The dispensing structure in accordance with claim 1 in which said cover is hingedly connected to said body.

9. The dispensing structure in accordance with claim 1 in which said bottom end closure member is hingedly connected to said body.

10. The dispensing structure in accordance with claim 1 in which said bottom end closure member is snap-fit into said body.

11. The dispensing structure in accordance with claim 1 in which said body defines an upper bore as part of said access passage; and said pusher member includes a round rod having an upper end received in said upper bore of said body.

12. The dispensing structure in accordance with claim 1 in which said bottom end closure member is mounted to said lower end of said pusher member.

13. The dispensing structure in accordance with claim 1 further including an upper closure member mounted to said pusher member upper end.

14. A dispensing structure for a container that has an opening to the container interior, said dispensing structure comprising:

a body for extending around said container opening and having an additive holding chamber which extends through said container opening and which has a bottom end opening;

a movable bottom end closure member at said chamber bottom end opening;

a movable push member which (1) is disposed in said chamber, (2) has an upper end, and (3) has a lower end which is adapted to move said bottom end closure member from a closed position to an open position when said push member is pushed downwardly;

at least one flexible arm that (1) is connected at one end with said body and at the other end with said push member, (2) is normally biased to an upwardly displaced configuration, and (3) accommodates movement of said support arm and push member to a downwardly displaced configuration; and a cover for accommodating movement between (1) a closed position over said body, and (2) an open position away from said closed position, said cover including (a) a peripheral frame for mounting on said body, (b) a top that (i) has interior and exterior surfaces, (ii) is connected with said frame, (iii) is normally biased to an outwardly convex configuration as viewed from outside said cover, and (iv) accommodates flexure of said top to a downwardly concave configuration for moving said at least one flexible arm and push member to said downwardly displaced configuration, and (c) an actuating member which projects from said cover top interior surface and which is adapted to push said push member downwardly when said cover top is moved to said inverted, downwardly displaced configuration.

15. A dispensing structure for a container that has an opening to the container interior, said dispensing structure comprising:

a body for extending around said container opening and defining an access passage for access through said container opening, said body including a chamber for receiving an additive product for adding to said container, said chamber having an initially closed upper end and having a bottom end defining a bottom end opening;

a movable closure means for releasably closing said chamber bottom end opening; and a deformable cover means for mounting to said body to accommodate deformation from an undeformed condition at which said closure means closes said chamber bottom end opening to a deformed condition at which said closure means is engaged and moved by said cover means to a moved position that opens said chamber bottom end opening.

16. The dispensing structure in accordance with claim 15 in which said dispensing structure body is separate from said container and includes an outer housing with an interior thread for threadingly engaging an exterior thread on said container.

17. The dispensing structure in accordance with claim 15 in which said body includes a membrane initially closing over said access passage; and said deformable cover means includes a penetrating point for penetrating said membrane when said cover means is in said deformed condition.

18. The dispensing closure in accordance with claim 15 in which said closure means includes:

a bottom end closure member movable between (1) a closed position occluding said chamber bottom end opening, and (2) an open position away from said closed position;

a movable push member which (1) is disposed in said chamber, (2) has an upper end adapted to be engaged and pushed downwardly by said cover means when said cover means is deformed, and (3) has a lower end which is adapted to move said bottom end closure member from said closed position to said open position when said push member is pushed downwardly; and at least one flexible support arm that (1) is connected at one end with said body and at the other end with said push member, (2) is normally biased to an upwardly displaced configuration, and (3) accommodates movement of said support arm and push member to a downwardly displaced configuration when said push member is pushed downwardly.

19. The dispensing structure in accordance with claim 18 in which said deformable cover means includes:

a cover for accommodating movement between (1) a closed position over said body, and (2) an open position away from said closed position, said cover including (a) a peripheral frame for mounting on said body, (b) a top that (i) has interior and exterior surfaces, (ii) is connected with said frame, (iii) is normally biased to an outwardly convex configuration as viewed from outside said cover, and (iv) accommodates flexure of said top to a downwardly concave configuration for moving said at least one flexible arm and push member to said downwardly displaced configuration, and (c) an actuating member which projects from said cover top interior surface and which is adapted to push said push member downwardly when said cover top is moved to said inverted, downwardly displaced configuration.

20. The dispensing structure in accordance with claim 19 in which said cover is hingedly connected to said body.

21. The dispensing structure in accordance with claim 18 in which said body is a multi-component assembly which includes at least (1) an inner housing that (i) is adapted to extend into said container opening, (ii) defines at least a portion of said body access passage and at least a portion of said chamber, (iii) has an upper end initially closed over said access passage, and (iv) has an open lower end, and (2) an insert sleeve which (i) is disposed in said inner housing for defining at least a portion of said body access passage and at least a portion of said chamber, (ii) has an upper end opening, and (iii) has a lower end opening defining said chamber bottom and opening;

said bottom end closure member is adapted to occlude said insert sleeve lower end opening when said bottom end closure member is in said closed position; and said support arm is connected at one end with said sleeve and supports said push member inside said sleeve.

22. The dispensing structure in accordance with claim 21 in which said bottom end closure member is hingedly connected to said insert sleeve.

23. The dispensing structure in accordance with claim 21 in which said insert sleeve is snap-fit into said body inner housing.

24. The dispensing structure in accordance with claim 18 in which said support arm includes at least one reduced thickness cross section region defining a hinge that accommodates flexure of said support arm to a self-maintained condition in said downwardly displaced configuration.

25. The dispensing structure in accordance with claim 18 in which said bottom end closure member is hingedly connected to said body.

26. The dispensing structure in accordance with claim 18 in which said bottom end closure member is snap-fit into said body.

27. The dispensing structure in accordance with claim 18 in which said body defines an upper bore as part of said access passage; and said pusher member includes a round rod having an upper end received in said upper bore of said body.

28. The dispensing structure in accordance with claim 18 in which said bottom end closure member is mounted to said lower end of said push member.

29. The dispensing structure in accordance with claim 18 further including an upper closure member mounted to said push member upper end.

* * * * *